United States Patent [19]

Tharrington et al.

[11] Patent Number: 4,679,700

[45] Date of Patent: Jul. 14, 1987

[54] SELF-CLOSING CONTAINER TOP

[76] Inventors: G. Robert Tharrington, 3901 Sawyer Wood Rd., Sarasota, Fla. 33583; Isabella A. Hodge, 2931 Coral Shores Dr., Ft. Lauderdale, Fla. 33306

[21] Appl. No.: 917,708

[22] Filed: Oct. 10, 1986

[51] Int. Cl.[4] ..... B65D 43/14

[52] U.S. Cl. ..... 220/337; 220/1 T; 232/1 R

[58] Field of Search ..... 220/1 T, 334, 337, 1 R; 232/43.1, 43.2, 43.5; 312/211, 290

[56] References Cited

U.S. PATENT DOCUMENTS

| | | | |
|---|---|---|---|
| 3,063,591 | 11/1962 | Gaginestra | 220/1 T |
| 3,825,150 | 7/1974 | Taylor | 220/1 T |
| 4,203,529 | 5/1980 | Torassa et al. | 220/334 |
| 4,603,791 | 8/1986 | Spierer et al. | 220/1 T |

*Primary Examiner*—George T. Hall
*Attorney, Agent, or Firm*—Charles J. Prescott

[57] ABSTRACT

A self-closing container top adapted to be used in conjunction with a container having an upper rim defining an opening. The invention includes two generally horizontal top panels supportively held for rotation about opposing coaxial mounting shafts each having a horizontal axis therethrough. These top panels are arranged in opposing side-by-side arrangement wherein their center margins form a common parting line. Each axis of top panel rotation is positioned between the center margin and the outer panel margin such that self-righting means returns the top panels to a generally horizontal closed position over the container opening and against stops. The stops prevent the panels from rotating beyond a point where the top panel center margins, moving upwardly, begin to diverge. The self-righting means may be a counterweight connected near or at each outer margin, or spring bias means mounted about at least one mounting shaft. The invention may be provided in various forms wherein the top panels are separate and removable, wherein the top panels are connected to the container rim, or wherein the top panels are mounted within a perimeter frame which, in turn, is removably supported atop the rim of a container.

8 Claims, 19 Drawing Figures

SELF-CLOSING CONTAINER TOP

BACKGROUND OF THE INVENTION

This invention relates generally to container tops for waste paper and clothes, and more paticularly to a self-closing container top having a unique configuration of self-closing top panels.

A variety of container and container top structures are disclosed in prior art. An early device described in U.S. Pat. No. 1,800,825 to Feltault discloses a laundry hamper mounted within a wall recess and having a pivotal spring bias closure lid 34 diagonally disposed about the hamper aperture 29.

Another such invention is disclosed in U.S. Pat. No. 1,860,224 to Bode which describes a laundry receptacle pivotedly mounted to swing outwardly from an aperture in a wall to reveal the container opening which is otherwise covered by a rigidly connected lid within the opening.

A cabinet type structure is disclosed in U.S. Pat. No. 1,917,363 to Fohn which describes, in part, an inner rectangular compartment including a spring biased vertically disposed trap door 19 which is spring biased generally closed. The receptacle 15 is withdrawable similar to a structure for a drawer to facilitate contents' removal.

A paper towel receptacle is disclosed in U.S. Pat. No. 2,125,420 to Bisson which includes a duplex flap device 32 pivoted about a central axis, self-righting by gravity about a tapered opening in the upper portion of the container. Additionally, a fan-shaped flap disposed within a mated opening is also provided as an additional mode for placing the contents within the container 20.

A display receptacle is disclosed in U.S. Pat. No. 2,294,068 to Budington which describes, in part, opposing spring biased movable covers 8 mounted about a central axis. The cabinet structure disclosed in U.S. Pat. No. 2,531,444 to Lane includes upper structure having dual pivotedly mounted closures 9 which, when opened, provide openings for depositing contents into hung flexible bags within a compartment therebelow. The hamper disclosed in U.S. Pat. No. 2,665,842 to Weintraub, et.al. discloses a conventional hamper structure having a pivotedly mounted horizontally disposed lid over a container which may be outwardly pivoted from the bottom to facilitate emptying. Unique laminates are the primary point of novelty disclosed in U.S. Pat. No. 3,692,235 to Franiel which also discloses a hamper or container type structure having a diagonally disposed pivotally mounted opening having an extendable handle 12 positioned therebelow.

The present invention discloses a self-closing container top having two opposing generally horizontally disposed top panels pivotedly mounted about axes each disposed between the center margin and outer margin of each top panel. The invention includes self-righting means which may be a counterweight or a spring bias device such as a torsional spring and which facilitates a convenient means for depositing contents within a container therebelow through the opening formed, typically by gravity against the upper surface of the top panels to rotate the panels downwardly about the axes at the center parting line between the panels. This invention may be provided in various forms in conjunction with conventional containers or containers which are adapted specifically to receive the invention.

BRIEF SUMMARY OF THE INVENTION

This invention is directed to a self-closing container top adapted to be used in conjunction with a container having an upper rim defining an opening. The invention includes two generally horizontal top panels supportively held for rotation about opposing coaxial mounting shafts each having a horizontal axis therethrough. These top panels are arranged in opposing side-by-side arrangement wherein their center margins form a common parting line. Each axis of top panel rotation is positioned between the center margin and the outer top panel margin such that self-righting means returns the top panels to a generally horizontal closed position over the container opening and against stops. The stops prevent the panels from rotating beyond a point where the top panel center margins, moving upwardly, begin to diverge. The self-righting means may be a counterweight connected near or at each outer margin, or spring bias means mounted about at least one mounting shaft. The invention may be provided in various forms wherein the top panels are separate and removable, wherein the top panels are connected to the container rim, or wherein the top panels are mounted within a perimeter frame which, in turn, is removably supported atop the rim of a container.

It is therefore an object of this invention to provide a selfclosing container top having two opposing generally horizontally disposed top panels rotatably mounted to provide convenient deposit of articles or refuge into the container.

It is another object to provide the above invention including self-closing features.

It is another object to provide the above invention adaptable to either existing containers, attachable to or placeable thereon, as well as being adapted in conjunction with a perimeter frame to be installable onto the upper rim of any convenient container.

It is another object to provide the above invention which is adapted for both refuge and clothes containers.

In accordance with these and other objects which will become apparent hereinafter, the instant invention will now be described with reference to the accompanying drawings in which:

DETAILED DESCRIPTION OF THE INVENTION

Figures 1, 2, 3, 4, 5, 6, 7, 8, 9:
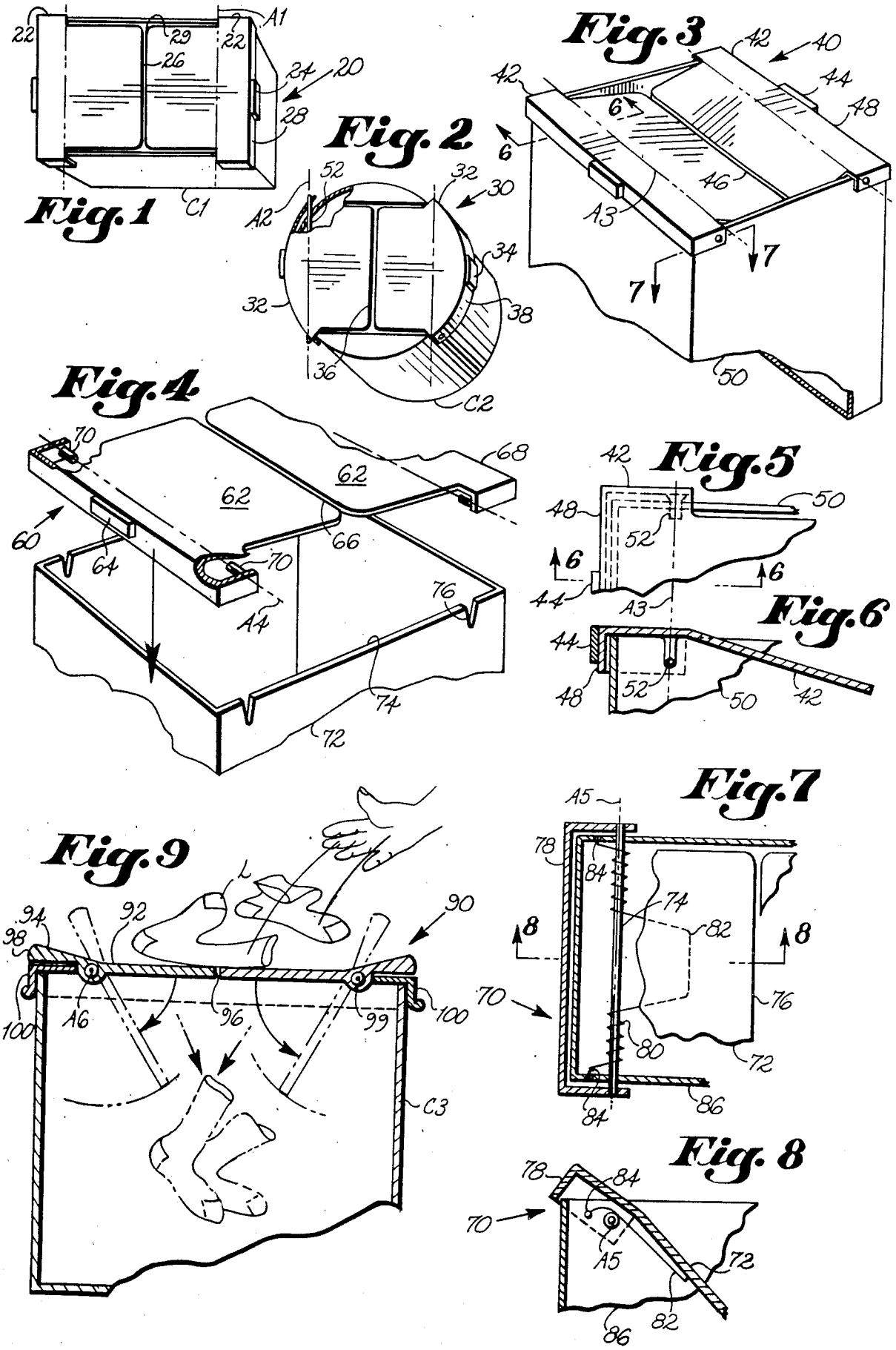
FIG. 1 is a perspective view of one embodiment of the invention.
FIG. 2 is a perspective partially broken view of another embodiment of the invention.
FIG. 3 is a perspective view of another embodiment of the invention.
FIG. 4 is an exploded perspective view of the embodiment of the invention shown in FIG. 1.
FIG. 5 is a partial top plan view of another embodiment of the invention.
FIG. 6 is a section view in the direction of arrows 6—6 in FIG. 5.
FIG. 7 is a section view in the direction of arrows 7—7 in FIG. 3.
FIG. 8 is a section view in the direction of arrows 8—8 in FIG. 7.
FIG. 9 is a side elevation section view of another embodiment of the invention.
Figure 10:
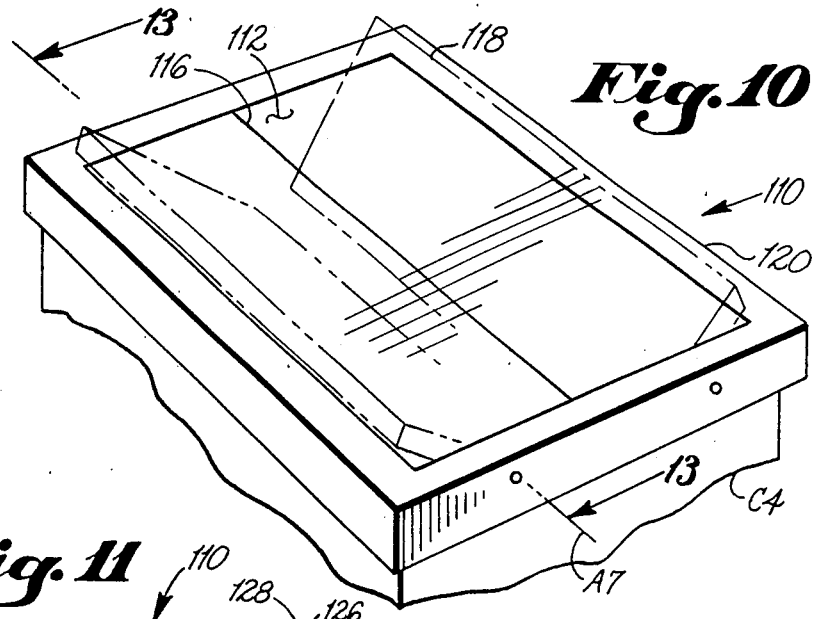
FIG. 10 is a perspective view of another embodiment of the invention which includes a perimeter frame.
Figure 11:
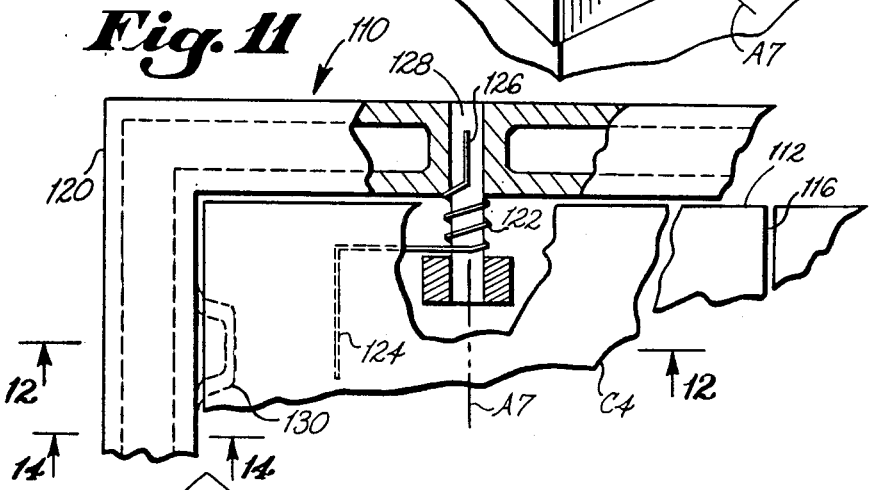
FIG. 11 is a partial broken top elevation view of the embodiment shown in FIG. 10.
Figure 14:
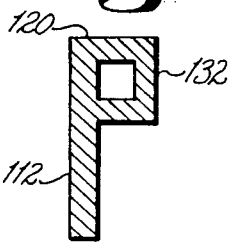
FIG. 14 is a section view in the direction of arrows 14—14 in FIG. 11.
Figure 12:
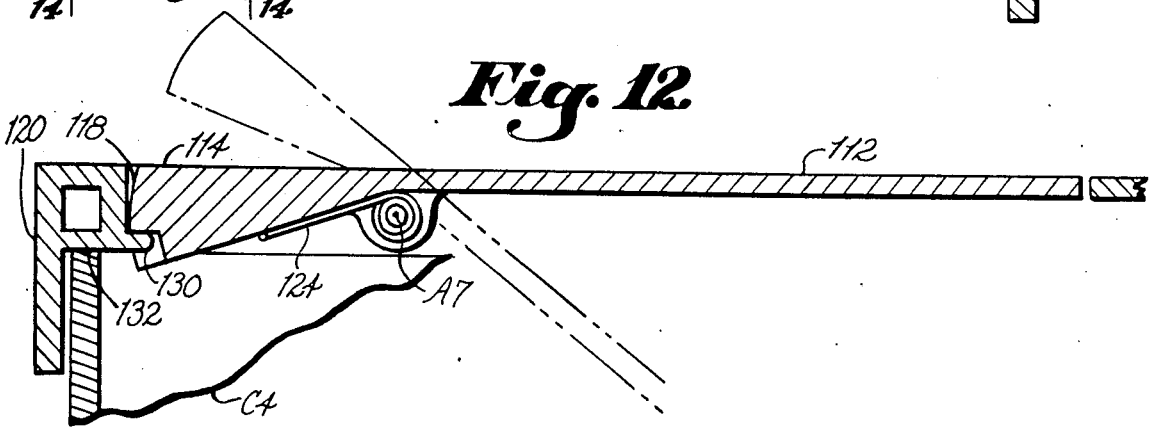
FIG. 12 is a section view in the direction of arrows 12—12 in FIG. 11.
Figure 13:
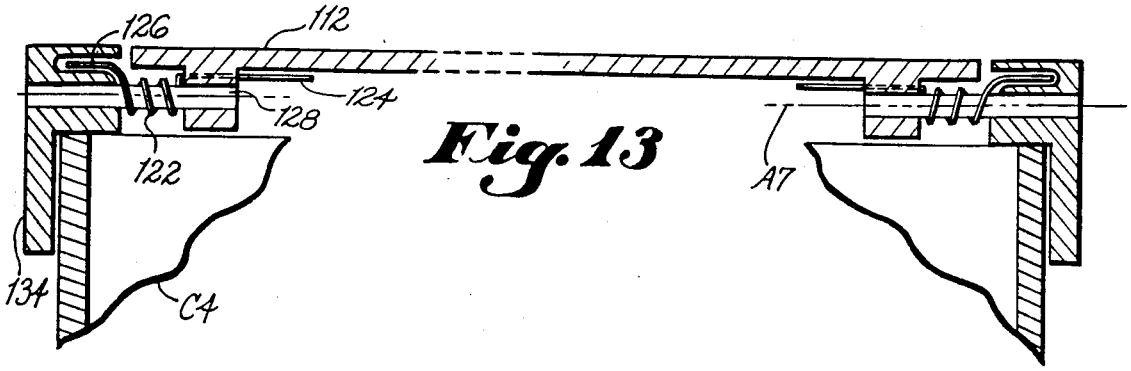
FIG. 13 is a section view in the direction of arrows 13—13 in FIG. 10.
Figure 15:
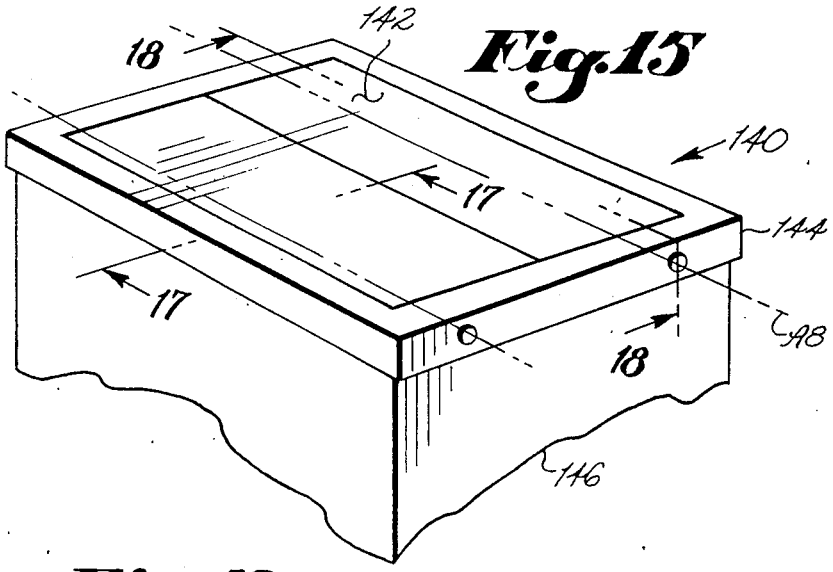
FIG. 15 is a perspective view of another embodiment of the invention which includes a perimeter frame.
Figure 16:
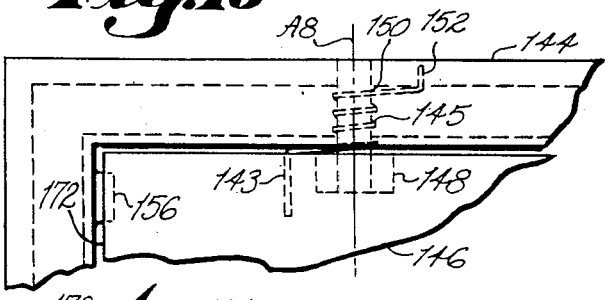
FIG. 16 is a partial top plan view of the embodiment of the invention shown in FIG. 15.

Referring now to the drawings and particularly to FIG. 1, the invention is shown generally at 20 and includes a pair of opposing horizontally disposed top panels 22 positioned atop container C1. Each top panel 22 is mounted for rotation about axis A1 wherein each center margin 26, mating and forming parting line 29, is generally downwardly disposed when contents are placed into the container C1. The outer margin 28 of each panel 22 includes counterweight 24 to bring the panels back to a horizontal closed position when at rest.

Referring to FIG. 2, another embodiment of the invention is shown at numeral 30. The container C2 is circular in cross section as opposed to container C1 which is rectangular. However, the invention is easily adapted to such containers. The top panels 32 are, in this embodiment 30, disposed on elongated metal rods 32 about rotational axes A2. The center margins 36, again mating to form a parting line are downwardly disposed when contents are placed into the container C2. Counterweights 34, attached along the outer margin 38, provide the self-righting feature of the invention in this embodiment 30.

Referring to FIGS. 3, 5 and 6, another embodiment of the invention is shown generally at 40 and includes a pair of mating top panels 42 having center margins 46 and rotational axes A3 functionally disposed as previously described. Counterweights are provided on the outer margins 48 to provide the self-righting feature of these top panels 42. This embodiment of the invention 40 is adapted to be rigidly connected to, and includes, container 50 by bolts 52 threadably engagable into the container 50 as shown.

Referring to FIG. 4, another embodiment of the invention 60 includes mating top panels 62 which are adapted to rest in place atop container 72 which includes upwardly disposed grooves 76 formed into the upper rim 74. These top panels 62 rest within grooves 76 on mounting shafts 70 which are rigidly disposed inwardly from the side the edges of top panels 62 as shown. Mounting shafts 70 on each top panel 62 are aligned with rotational axis A4. In this embodiment 60, counterweights 64, attached along outer margins 68, provide the self-righting feature which returns the panels to a generally horizontal position when at rest whereby center margins 66 mate and align to provide a complete cover over the upper rim 74 forming the opening of the container 72.

Referring now to FIGS. 7 and 8, another embodiment of the invention is shown generally at 70 and includes top panels 72 which are rotationally connected about axes A5 to container 86 by elongated shaft 74. Positioned about shaft 74 is a torsional spring 80 having each end 84 embedded into an aperture provided in the wall of container 86 while the center portion 82 is shaped to provide self-righting pressure against the underside of the top panels 72. The outer margin 78 is flanged to provide additional structure and weight to enhance the self-closing features of this embodiment of the invention.

Referring to FIG. 9, another embodiment of the invention is shown generally at 90 which is removable and intended to fit over the upper rim of container C3. This embodiment 90 includes bezels 100 which are each rotationally connected to one top panel 92 along axis A6 by mounting shafts 99. The self-closing feature of this embodiment 90 is in the form of a counterweight portion 94 which is a thickening in the cross section of top panels 92. As can be readily appreciated, as laundry of the like is placed or tossed atop the top panels 92, they are easily downwardly disposed in the direction of the arrows to allow the laundry to fall into the container C3. Thereafter, the counterweight portion 94 returns the top panels 92 to their closed generally horizontal position against bezels 100 which also serve as stops.

Referring now to FIGS. 10 through 14, another embodiment of the invention is shown generally at 110 and includes perimeter frame 120 which serves to provide mounting means for the mating pair of top panels 112 about rotational axes A7. The top panels 112 are mounted within the frame 120 by mounting shafts 128. Positioned around each mounting shaft 128 is a torsional spring 122 having one end 126 embedded within the frame 120, while the other end 124 is adapted to apply pressure upwardly to the counterweight portion 114 to assist in the ease of opening top panels 112. However, the counterweight portion 114 is sized to more than adequately overcome the torsional spring 122 opening assistive effort to quickly bring the top panels 112 back to a horizontal closed position. Stop 130, integral with the frames, are provided to contact against the outer margin 118 to prevent each top panel 112 from rotating about axis A7 beyond a point wherein the center margins 116 move upwardly divergent one to another.

This embodiment of the invention 110 is adapted, by the incorporation of panels 112 into frame 120, to rest atop the upper rim 132 of container C4 which is of any convenient size and shape, thereby rendering this embodiment 110 adaptable to virtually any existing container C4, whether it be a clothes hamper or trash container.

To reiterate the essence of the invention, then, each embodiment of the invention includes a pair of mating top panels which are disposed for rotation, either by support atop the upper rim of a container, or within a supportive frame, along axes of rotation which is disposed between the center margin and the outer margin of each top panel. a self-righting feature is provided, either in the form of a torsion spring, or counterweight such that the top panels are self-righting against a stop. Such stop may be in the form of built-in structure of a frame, or the rim of the container. By this invention, then, the top panels are easily downwardly disposed about their respective horizontally disposed rotational axes by placing or tossing refuse, laundry, or the like atop the top panels generally anywhere between the axes, thereby downwardly rotating the center margins of the top panels to allow the contents to fall into the container.

Figure 17:
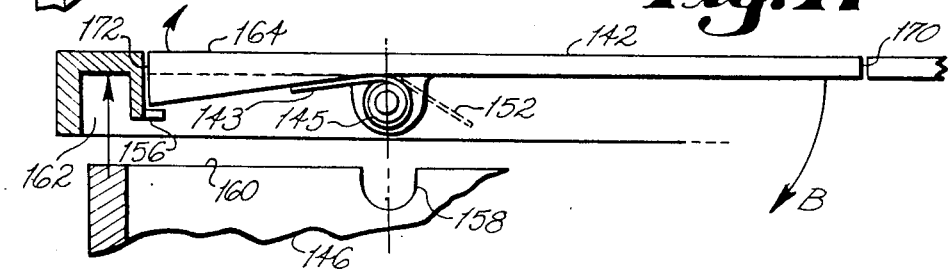
FIG. 17 is a section view in the direction of arrows 17—17 in FIG. 15.
Figure 18:
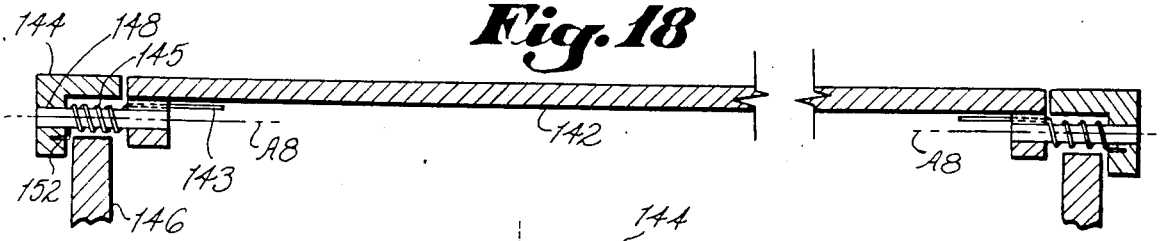
FIG. 18 is a section view in the direction of arrows 18—18 in FIG. 15.
Figure 19:
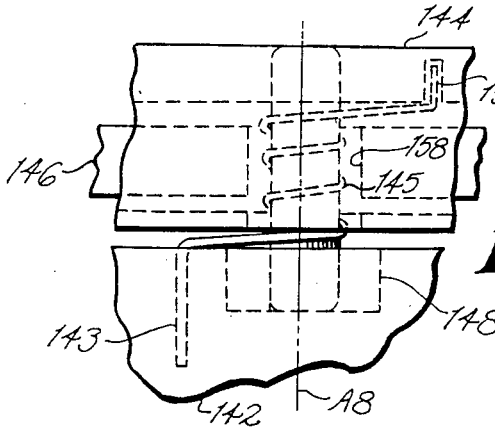
FIG. 19 is an enlarged partial top plan view of the mounting shaft and spring biased self-closing portion of the embodiment of the invention shown in FIG. 15.

Referring lastly to FIGS. 15 through 19, another embodiment of the invention is shown generally at 140 and includes a perimeter frame 144 which supportively retains top panels 142 for rotation about axes A8. This embodiment 140 is intended to be supported atop container 146 which includes upwardly disposed grooves 158 as best seen in FIG. 17. Top panels 142 are held for rotation by mounting shafts 148. Mounted around mounting shafts 148 are torsion springs 145 having one end 152 embedded within the frame 144 and the other end 143 exerting pressure upwardly against the bottom surface of the counterweight portion 164 of top panel 142. Channels 162 are provided to additionally stabilize and secure the frame 144 atop the upper rim 160 of container 146. Stops 156, connected to the frame 144, are provided to ensure that the top panel 142 does not rotate about axis A8 beyond a point where the center margins 170 move upwardly in a divergent fashion one to another. In essence, stops 156, then, maintain top panels 142 in a generally horizontal position when at rest. The only movement permitted is when refuse, laundry or the like is placed atop the top panels 142 between axes A8 which then downwardly dispose the portion of the panels 142 between center margin 170 and axes A8 in the direction of arrow B.

In this embodiment, both self-righting forces are incorporated, those being the torsional spring 145, and the counterweight in the form of the enlarged section 164 of the top panel 142. This enlarged section 164 is disposed between the axis of rotation A8 and the outer margin 172 of ech panel 142.

While the instant invention is shown and described herein in what is conceived to be the most practical and preferred embodiment, it is recognized that departures may be made therefrom within the scope of this invention, which is therefore not to be limited to the details disclosed herein, but is to be accorded the full scope of the claims so as to embrace any and all equivalent apparatus and articles.

What is claimed is:

1. A self-closing container top adapted to be supportively received over a container having an upper rim defining an opening, said container top comprising:

two generally horizontal top panels each supportively disposed for rotation about opposing coaxial mounting shafts having a generally horizontal axis;

each said top panel having a center margin and an outer margin;

said top panels in opposing side-by-side arrangement one to another forming a common parting line between one said center margin to another;

each said axis disposed from said center margin but not to said outer margin;

stop means for preventing each said top panel from rotating about said axis beyond a position wherein said center margins become upwardly divergent;

counterweight means disposed on each said top panel between each said axis and said outer margin for self-righting said top panels to a closed position wherein each said top panel is against said stop means and generally horizontal;

said container top substantially covering the container opening when said top panels are in said closed position.

2. A self-closing container top as set forth in claim 1, wherein:

said top panels are connected about said shafts to the container rim;

said stops are a portion of the container rim.

3. A self-closing container top as set forth in claim 1, wherein:

said shafts are adapted to be received into and supported by opposing upwardly disposed grooves formed in the upper rim of the container.

4. A self-closing container top as set forth in claim 1, further comprising:

a frame having an opening adapted to receive said top panels;

said top panels connected by rotation about said shafts to said frame;

said top panels substantially filling said frame opening when said top panels are in said closed position;

said frame also adapted to substantially cover and be supported by the container opening and rim respectively.

5. A self-closing container top adapted to be supportively received over a container having an upper rim defining an opening, said container top comprising:

two generally horizontal top panels each supportively disposed for rotation about opposing coaxial mounting shafts having a generally horizontal axis;

each said top panel having a center margin and an outer margin;

said top panels in opposing side-by-side arrangement one to another forming a common parting line between one said center margin to another;

each said axis disposed from said center margin but not to said outer margin;

stop means for preventing each said top panel from rotating about said axis beyond a position wherein said center margins become upwardly divergent;

spring bias means disposed about one said mounting shaft for self-righting each said panel to a closed position wherein each said panel is against said stop means and generally horizontal;

said container top substantially covering the container opening when said top panels are in said closed position.

6. A self-closing container top as set forth in claim 5, wherein:

said top panels are connected about said shafts to the container rim;

said stops are a portion of the container rim.

7. A self-closing container top as set forth in claim 5, wherein:

said shafts are adapted to be received into and supported by opposing upwardly disposed grooves formed in the upper rim of the container.

8. A self-closing container top as set forth in claim 5, further comprising:

a frame having an opening adapted to receive said top panels;

said panels connected for rotation about said shafts to said frame;

said top panels substantially filling said frame opening when said panels are in said closed position;

said frame also adapted to substantially cover and be supported by the container opening and rim respectively.

* * * * *